US006983795B2

(12) United States Patent
Zuklic et al.

(10) Patent No.: US 6,983,795 B2
(45) Date of Patent: Jan. 10, 2006

(54) DOWNHOLE ZONE ISOLATION SYSTEM

(75) Inventors: Stephen N. Zuklic, Kingwood, TX (US); Allen W. Womble, Maurice, LA (US); Wilfred Schexnayder, Jr., Houston, TX (US); Gary Corbett, Willis, TX (US); Richard Y. Xu, Tomball, TX (US); David Rothers, The Woodlands, TX (US); Brian Roth, Houston, TX (US); Russell T. Louviere, Arnaudville, LA (US)

(73) Assignee: Baker Hughes Incorporated, Houston, TX (US)

( * ) Notice: Subject to any disclaimer, the term of this patent is extended or adjusted under 35 U.S.C. 154(b) by 325 days.

(21) Appl. No.: 10/408,798

(22) Filed: Apr. 7, 2003

(65) Prior Publication Data

US 2004/0045709 A1 Mar. 11, 2004

Related U.S. Application Data

(60) Provisional application No. 60/370,911, filed on Apr. 8, 2002.

(51) Int. Cl.
*E21B 43/08* (2006.01)

(52) U.S. Cl. ..... 166/51; 166/278; 166/227

(58) Field of Classification Search ..... 166/51, 166/296, 278, 236, 233, 227, 228
See application file for complete search history.

(56) References Cited

U.S. PATENT DOCUMENTS

| | | | | |
|---|---|---|---|---|
| 3,831,632 A | | 8/1974 | Young | |
| 4,440,218 A | * | 4/1984 | Farley | 166/51 |
| 4,457,368 A | | 7/1984 | Knierimen et al. | |
| 4,510,995 A | | 4/1985 | Krause, Jr. et al. | |
| 4,771,829 A | * | 9/1988 | Sparlin | 166/233 |
| 4,823,872 A | | 4/1989 | Hopmann | |
| 4,858,690 A | * | 8/1989 | Rebardi et al. | 166/278 |
| 5,156,220 A | | 10/1992 | Forehand et al. | |
| 5,174,379 A | | 12/1992 | Whiteley et al. | |
| 5,413,180 A | | 5/1995 | Ross et al. | |
| 5,609,204 A | * | 3/1997 | Rebardi et al. | 166/51 |
| 5,865,251 A | | 2/1999 | Rebardi et al. | |
| 6,059,041 A | | 5/2000 | Scott | |
| 6,227,303 B1 | * | 5/2001 | Jones | 166/378 |
| 6,230,801 B1 | | 5/2001 | Hill, Jr. et al. | |
| 6,230,811 B1 | | 5/2001 | Ringgenberg et al. | |
| 6,237,687 B1 | | 5/2001 | Barbee, Jr. et al. | |
| 6,253,861 B1 | | 7/2001 | Carmichael et al. | |
| 6,260,616 B1 | | 7/2001 | Carmody et al. | |
| 6,405,800 B1 | | 6/2002 | Walker et al. | |
| 6,446,729 B1 | | 9/2002 | Bixenman et al. | |
| 6,609,569 B2 | | 8/2003 | Howlett et al. | |
| 2002/0148610 A1 | | 10/2002 | Bussear et al. | |

OTHER PUBLICATIONS

Osca Technical Bulletin, "The ISO System," 1 page, 2000.
Osca Technical Bulletin, "Pressure Actuated Circulating Valve," 1 page, 2000.

* cited by examiner

*Primary Examiner*—Frank Tsay
(74) *Attorney, Agent, or Firm*—Steve Rosenblatt

(57) ABSTRACT

A gravel packing system featuring pressure actuated sliding sleeve valves mounted to an exterior annulus around a blanking pipe for screen sections is disclosed. An internal sliding sleeve valve is provided for subsequent closure of access through the screens. The presence of the annulus between the blanking pipe and the screen permits a backup access through perforating the blanking pipe while not damaging the screen. The sliding sleeve valves that are mounted internally and externally on the blanking pipe are removable apart from the screen section that already has gravel packed around it, if they fail to operate and need repair.

28 Claims, 8 Drawing Sheets

DOWNHOLE ZONE ISOLATION SYSTEM

PRIORITY INFORMATION

This application claims the benefit of U.S. Provisional Application No. 60/370,911 on Apr. 8, 2002.

FIELD OF THE INVENTION

The field of this invention is downhole gravel packing systems with valves to isolate or allow access to various zones.

BACKGROUND OF THE INVENTION

Typically in a gravel pack completion, a sump packer is set in the wellbore and the formation is perforated. The perforating gun is removed and a gravel packing assembly is installed. Screens are part of this assembly as is a crossover tool. The crossover tool is secured to a production packer. The production packer is set and the crossover is configured in a manner so as to allow pumping gravel through the production packer and into the annular space outside the screens. Return fluid, less the deposited gravel, goes through the production screen and through a valve in a blank pipe in the screen, back through the crossover and out the annular space above the set production packer. A closing tool on a wash pipe in a concentric string closes the sliding sleeve valve(s) when the crossover tool is pulled at the conclusion of the gravel packing operation. After the production string is run to the production packer, access to the formation involved using wireline or service string through the production packer to shift the internally mounted sliding sleeve(s) to gain access to the producing formation. This technique is illustrated in U.S. Pat. No. 5,609,204 assigned to OSCA Inc. of Lafayette, La.

Subsequently, OSCA developed internally mounted pressure actuated circulating valves. These valves were integral to each section of screen assembly. Each screen section had a non-perforated base pipe having the sliding sleeve valve over a series of openings mounted on each screen section. For long screen intervals, numerous valves were required to be manipulated for full access to the producing zone. The close fit of these sliding sleeves to the screen and the integral construction did not allow for alternate access to the formation if such valves refused to open. Additionally, the integral construction with the screen sections precluded removal of such valves if they failed to operate without removing the entire screen assembly integral to such sliding sleeve valves. The presence of gravel exterior to the screens made it problematic to remove the screen assembly after deposition of the gravel.

Other commercially available systems from Schlumberger and Weatherford used isolation ball valve systems as opposed to concentric isolation string hookups.

The present invention seeks to address several limitations in the prior systems. It not only allows access to multiple zones with pressure actuated valves that open after pressure is applied and then removed, but it also allows through the use of a redundant valve, the ability to close off the access to a given layer should that be necessary, while maintaining the capability of re-accessing the zone at a later date. Should the main valves not open in response to application and removal of pressure, the annular gap to the screen allows for access through the blank pipe without damaging the screen. Additionally, by placing the access valves on a removable portion of the inner string, the invention permits removal of the access valve while leaving the screen and surrounding gravel pack in place. The use of this inner string, separate from the screen, also permits the use of systems which manipulate the entire concentric string itself in order to provide alternate flow paths during packing operations. These and other benefits of the invention will become clearer to those skilled in the art from a review of the description of the preferred embodiment and the claims, which appear below.

SUMMARY OF THE INVENTION

A gravel packing system featuring pressure actuated sliding sleeve valves mounted to an exterior annulus around a blanking pipe for screen sections is disclosed. An internal sliding sleeve valve is provided for subsequent closure of access through the screens. The presence of the annulus between the blanking pipe and the screen permits a backup access through perforating the blanking pipe while not damaging the screen. The sliding sleeve valves that are mounted internally and externally on the blanking pipe are removable apart from the screen section that already has gravel packed around it, if they fail to operate and need repair.

DETAILED DESCRIPTION OF THE DRAWINGS

DETAILED DESCRIPTION OF THE PREFERRED EMBODIMENT

Figure 1:
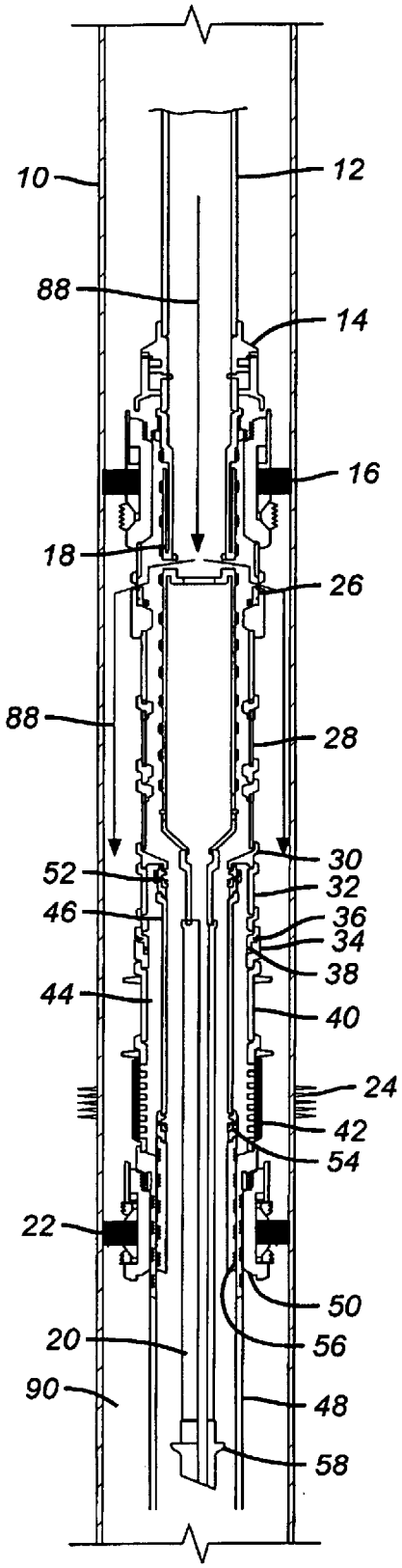
FIG. 1 is an elevation view of the assembly in the run in position.

The gravel packing assembly of the present invention is illustrated in FIG. 1. A cased wellbore 10 is illustrated with a run in string 12 supporting a setting tool 14 to actuate the packer 16. A crossover tool 18 is supported from the setting tool 14 and a wash pipe 20 is, in turn, supported off the crossover tool 18. Down below is a sump packer 22 that has earlier been set in the well, generally before perforations 24 have been made, using a perforating gun of a type well known in the art.

Suspended from the isolation packer 16 is a frac sleeve valve 26, which is run in the open position. Below the sleeve valve 26 are tubulars or blank pipe 28 followed by a two-pin sub 30. The external assembly connected to the two pin sub 30 comprises a tubular 32 followed by a breakaway coupling 34 (seen more easily in the enlarged view in FIG. 8). Shear pin 36 holds coupling 34 together and seal 38 prevents leakage, when the coupling 34 is intact. Below coupling 34 are additional tubulars 40 followed by a screen or screens 42 to a length as required by the depth of the formation producing through perforations 24. The specific screen construction can vary and many known designs can be used. It is worthy of emphasis that there is an annular gap 44 between the screen 42 and the internal blanking pipe 46. Continuing on below the screen 42 is a production pipe 48 that sealingly extends into a seal bore 50 in the sump packer 22.

Figure 4:
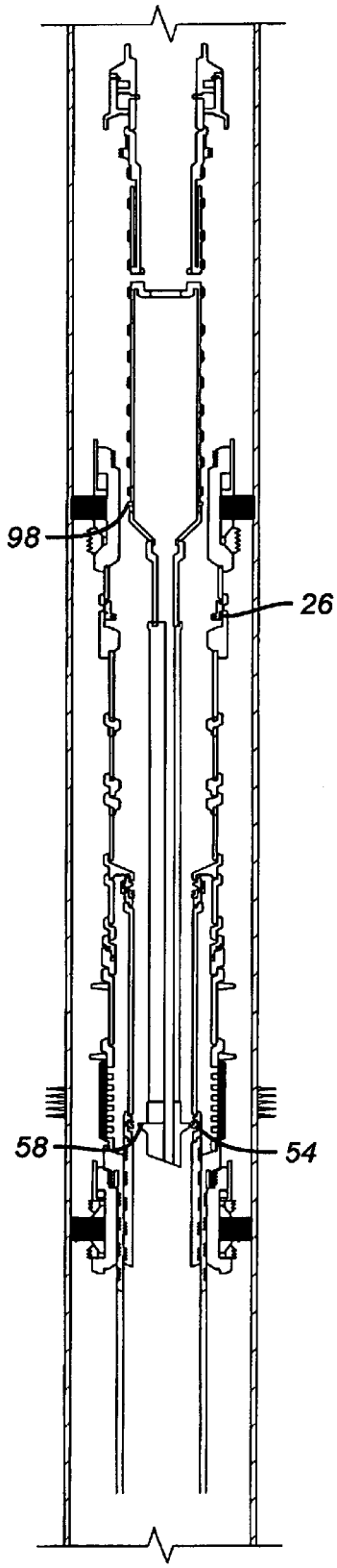
FIG. 4 is the views of FIG. 3 shown in the pull out position.
Figure 6:
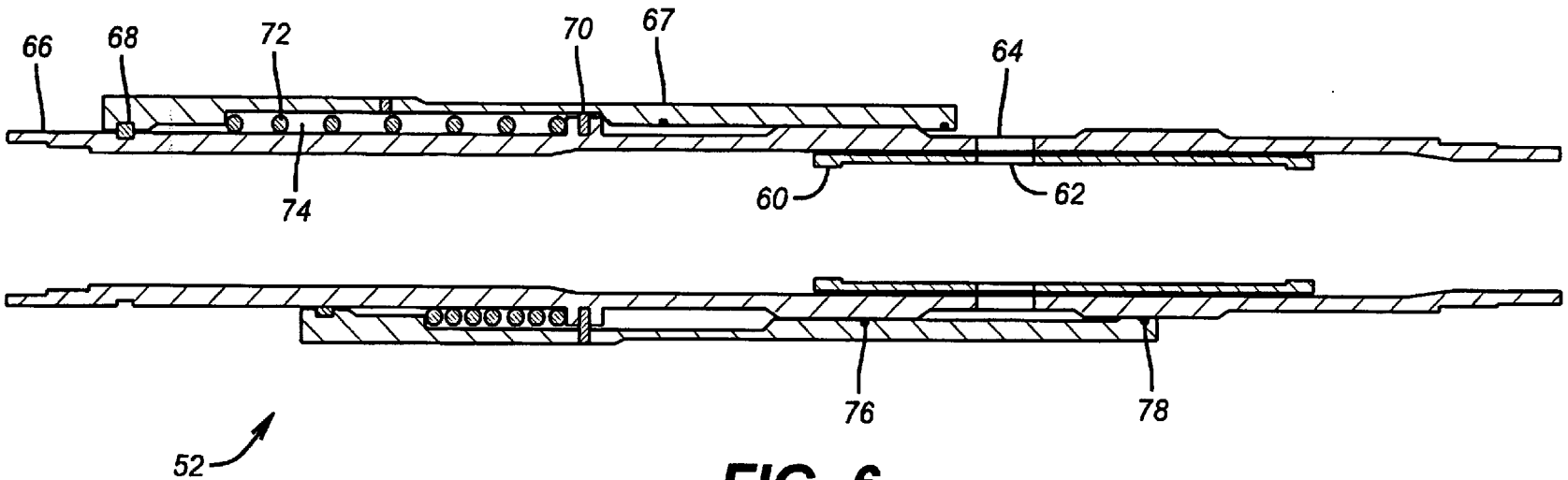
FIG. 6 is a split view of the pressure actuated sliding sleeve valve in the open and closed positions.

Starting on the inside of the two-pin sub 30 is a valve assembly 52, shown in larger detail in FIG. 6. The valve assembly 52 supports blanking pipe 46, which has a sliding sleeve valve 54 in it and a seal assembly 56 at its lower end to sealingly engage the production pipe 48. Sliding sleeve valve 54 is run in open and is subsequently closed when the wash pipe 20 is removed and closure mechanism 58 engages the sliding sleeve valve 54, as shown in FIG. 4.

Referring now to FIG. 6, the valve assembly 52 further comprises an internal sliding sleeve 60 having an opening or openings 62 that are in alignment with opening or openings 64 in the tubular 66. Stated differently, for run in, openings 64 are not obstructed by sliding sleeve 60 but are obstructed by sliding sleeve 67 mounted externally to the tubular 66. Sliding sleeve 67 has a pair of seals 76 and 78 that span openings 64 and are at unequal diameters such that pressure applied within tubular 66 tends to put an unbalanced force on sliding sleeve 67 moving it in a direction that breaks shear pin 70 while moving in a direction to compress spring 72. When applied pressure is released, spring 72 moves sliding sleeve 67 until a snap ring 68 expands into groove 80 to lock the sliding sleeve 67 in the open position. Spring 72 is disposed in annular space 74.

Figure 7:
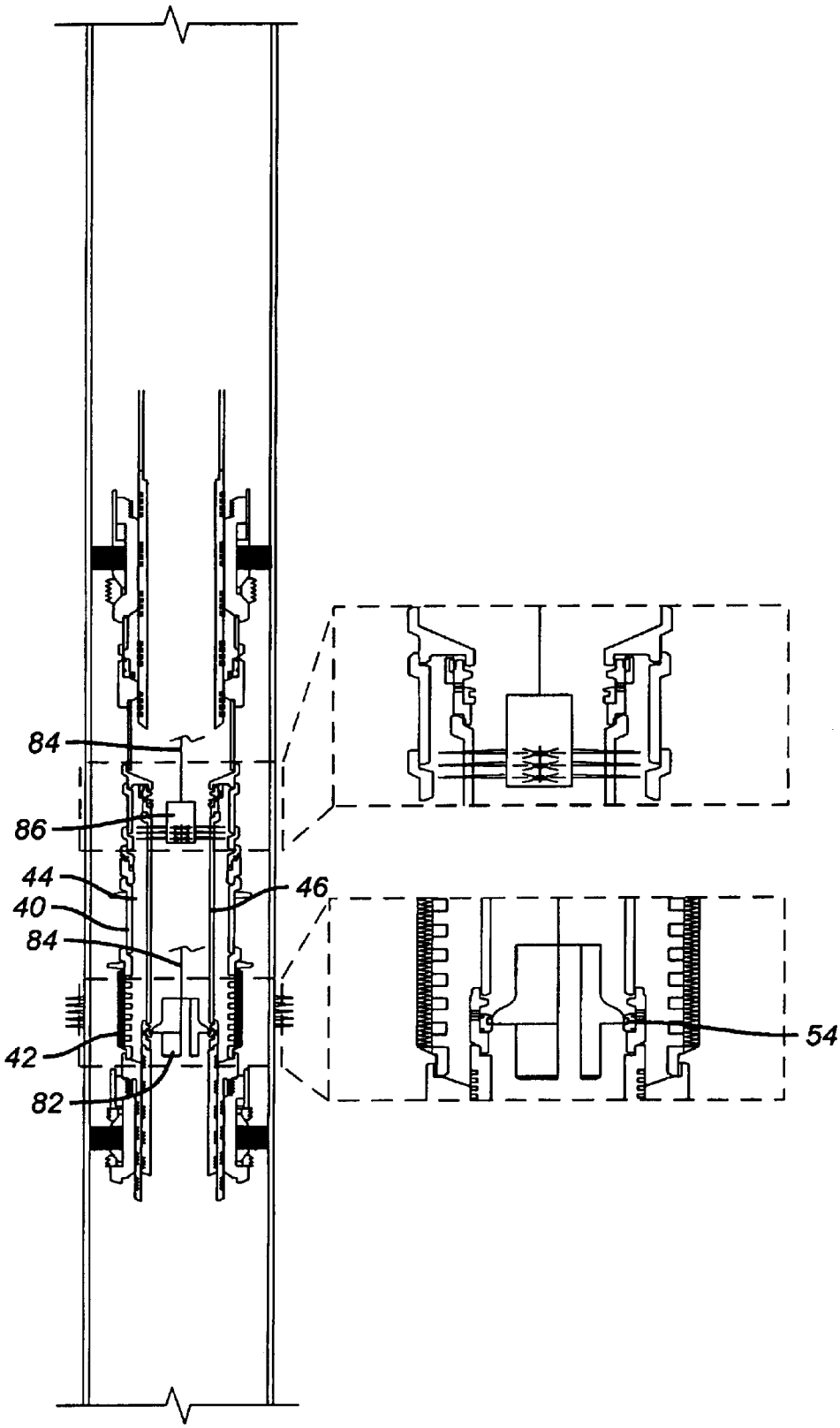
FIG. 7 illustrates the way of getting alternate access through the blanking pipe if the sliding sleeve valve does not operate properly.

FIG. 7 illustrates some back up techniques to deal with the issue of a particular sliding sleeve valve 67, of which there are preferably one in each producing formation, fails to open with the applied pressure technique just described. The primary backup technique is to remove the wash pipe 20 and the cross-over 18 and run in a shifting tool 82 on slick line or equivalent 84 and operate sliding sleeve 54 back to the open position. It should be remembered that removing the wash pipe 20 causes the closure mechanism 58 to close sliding sleeve 54. If that doesn't work a mini-perforating tool 86 run in on slick line or equivalent 84 can be positioned in blanking pipe 46to penetrate only into the annular gap 44, without risk of doing damage to tubulars 40 in a manner that would allow formation fluid to bypass the screens 42.

The operation of the assembly shown in FIGS. 1-5 will now be described. As previously stated, the sump packer 22 is run in and set in the cased wellbore 10. Perforation in the known manner creates perforations 24. A run in string 12 supports the assembly as previously described until it reaches the perforations 24. The packer 16 is set. If needed a squeezing operation into perforations 24 can take place. Arrows 88 in FIG. 1 show the flow direction of treatment chemicals as going down the run in string 12 and through crossover 18 into annular space 90 and into the perforations 24. The position of the crossover 18 in FIG. 1 prevents return flow uphole even though sliding sleeve valve 54 is open at this time.

Figure 2:
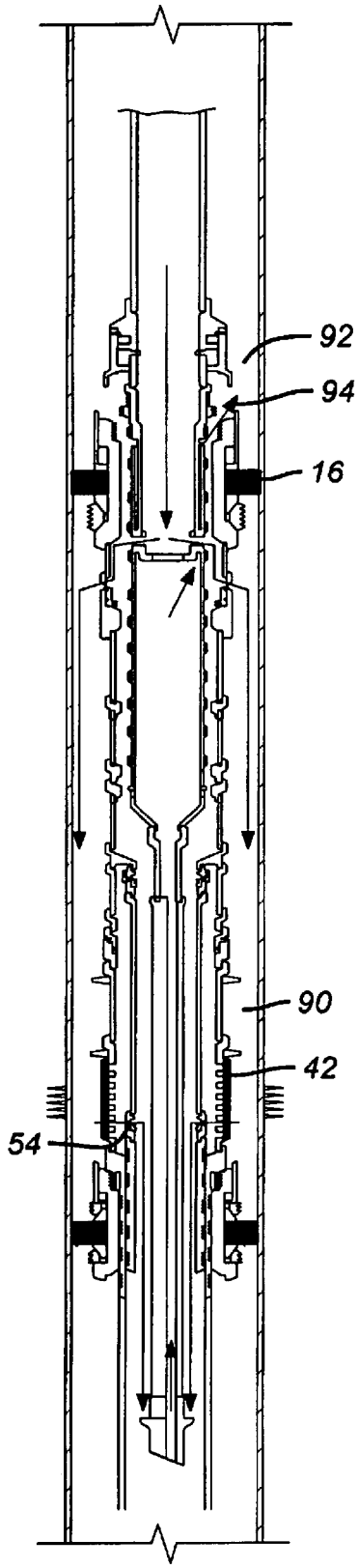
FIG. 2 is the views of FIG. 1 shown in the circulate position.

Going to FIG. 2, the circulation of gravel outside the screen 42 occurs as a result of a pick up of the cross-over 18 to allow fluid to flow through screen 42, leaving the gravel behind in annular space 90. Fluid continues through sliding sleeve valve 54 and down to the bottom of the wash pipe 20, then up to the cross-over 18 and through it and into the annular space 92 above packer 16 and out to the surface, as shown by arrow 94.

Figure 3:
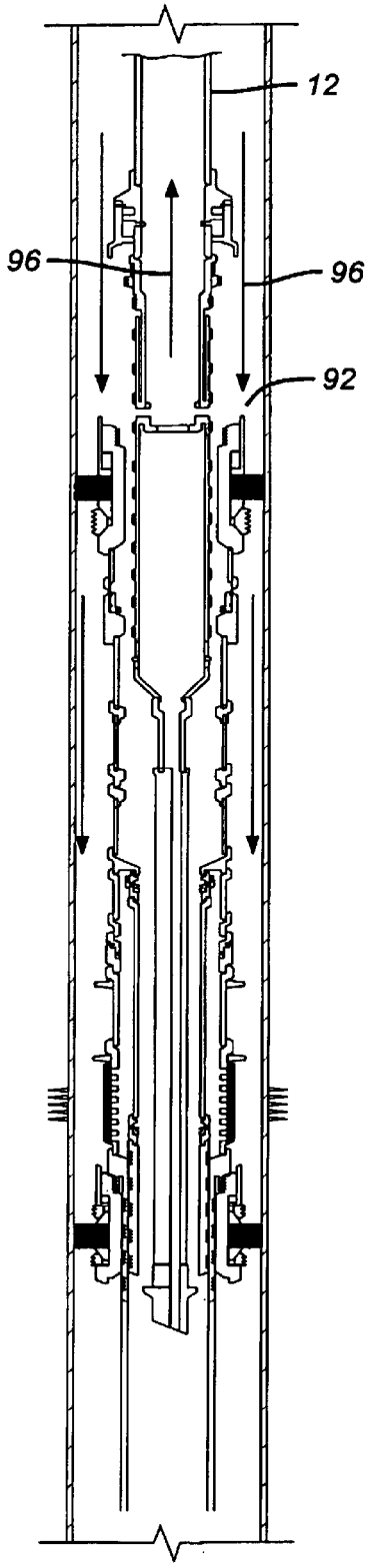
FIG. 3 is the views of FIG. 2 shown in the reverse position.

When the gravel has been duly deposited, the cross-over 18 is picked up, as shown in FIG. 3, and flow into annular space 92 arrives from the surface to go through the cross-over 18 and back up the run in string 12. This flow pattern, illustrated by arrows 96 allows the remaining gravel in the system to be flushed out to the surface.

The next step, shown in FIG. 4, is to pull out the crossover tool 18 and the wash pipe 20. As a result, the closure mechanism 58 closes sliding sleeve valve 54. This movement of the crossover tool 18 allows a closure mechanism 98 mounted on it to close frac sliding sleeve valve 26.

Figure 5:
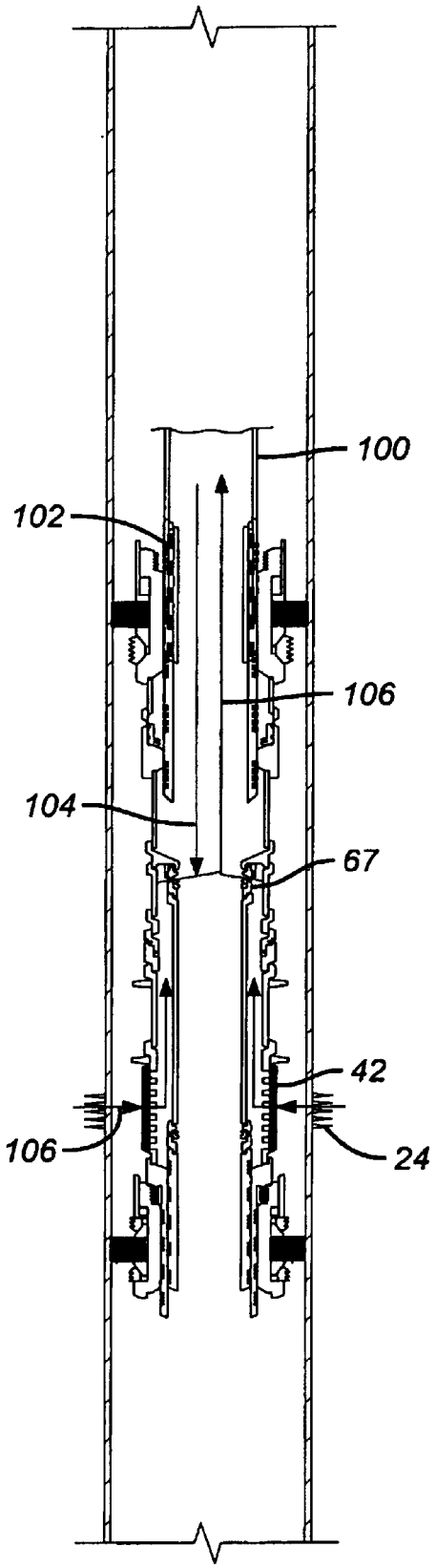
FIG. 5 is the views of FIG. 4 shown in the produce position.

At this point, shown in FIG. 5, production tubing 100 with a seal assembly 102 is tagged into the packer 16. Pressure can be applied from the surface through the production tubing 100 and it will communicate to every closed valve assembly 52 in the wellbore. Each valve assembly 52 has a shear pin 70 and the various shear pins at different intervals can be set at different levels. Operating personnel, depending on the amount of pressure applied can open all or some of the valves 67. As long as pressure is applied, shown as arrow 104 none of the valves 67 will actually be biased to open. This allows the pressure to be progressively raised to a level to break all shear pins 70 before the applied pressure can escape through opening of any of the sliding sleeve valves 67. If the pressure is subsequently removed from the surface, production starts from the perforations 24 through the opened sliding sleeve valves 67 to the surface through the production tubing 100, as indicated by arrow 106.

Figure 8:
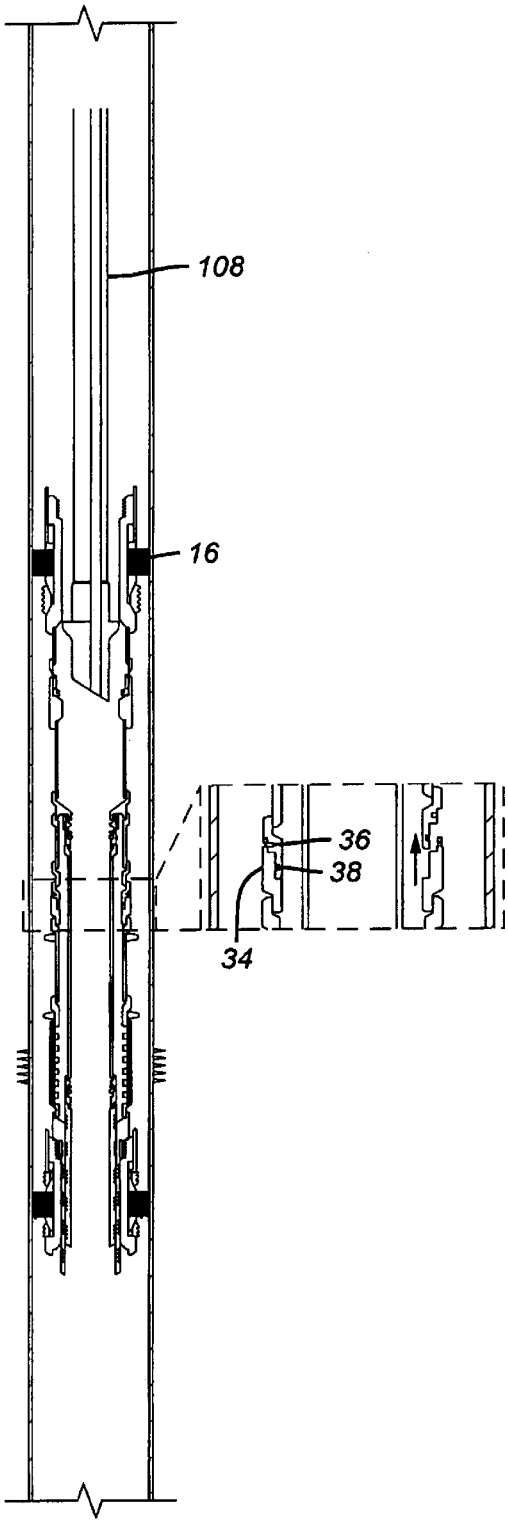
FIGS. 8–10 illustrate the pull out feature of the concentric pipe assembly.
Figure 9:
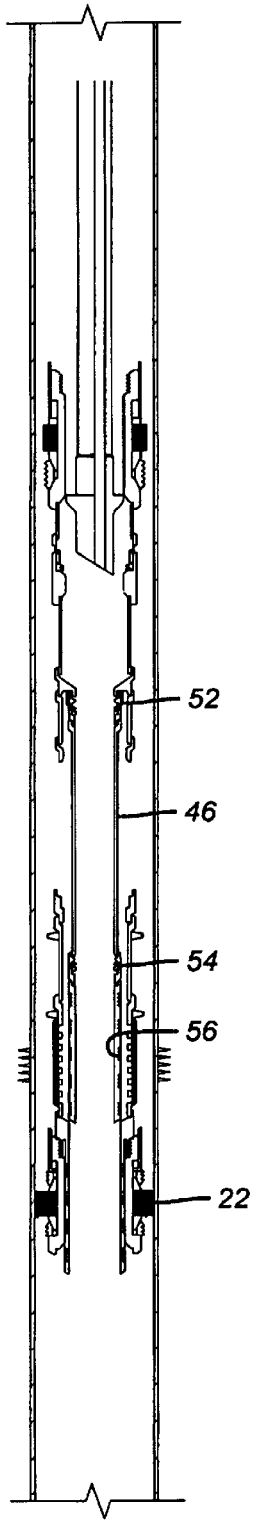
Figure 10:
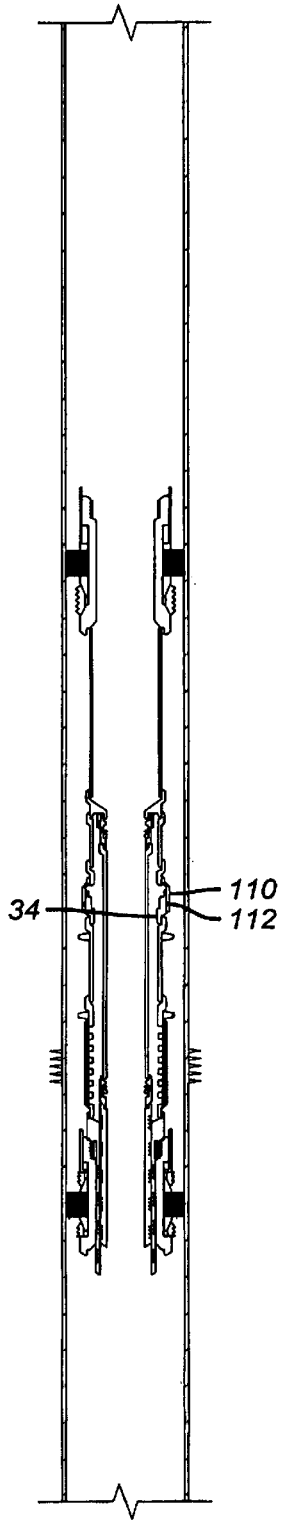

FIGS. 8–10 illustrate a feature that allows leaving the screens 42 in place while removing the valve assembly 52 with blanking pipe 46 and seal assembly 56 from sump packer 22. A retrieving tool 108 is run in and engaged to packer 16 before packer 16 is released, as shown in FIG. 8. The detailed portion of FIG. 8 shows what happens after the packer 16 is released and an upward pull breaks shear pin 36 of breakaway coupling 34. When coupling 34 comes apart, the retrieving tool 108 pulls out valve assembly 52, blanking pipe 46, sliding sleeve valve 54 and seal assembly 56, as shown in FIG. 9. Subsequently a replacement assembly of the same components is run back into the cased wellbore 10 except that a packoff overshot 110 with a seal 112, which replaces the seal 38 in the breakaway coupling 34 that used to be there, is sealingly connected to the remaining half of the breakaway coupling 34. The ability to replace this assembly without pulling the screens is an advantage since after gravel packing, the screen 42 may be very difficult to dislodge.

Figure 11:
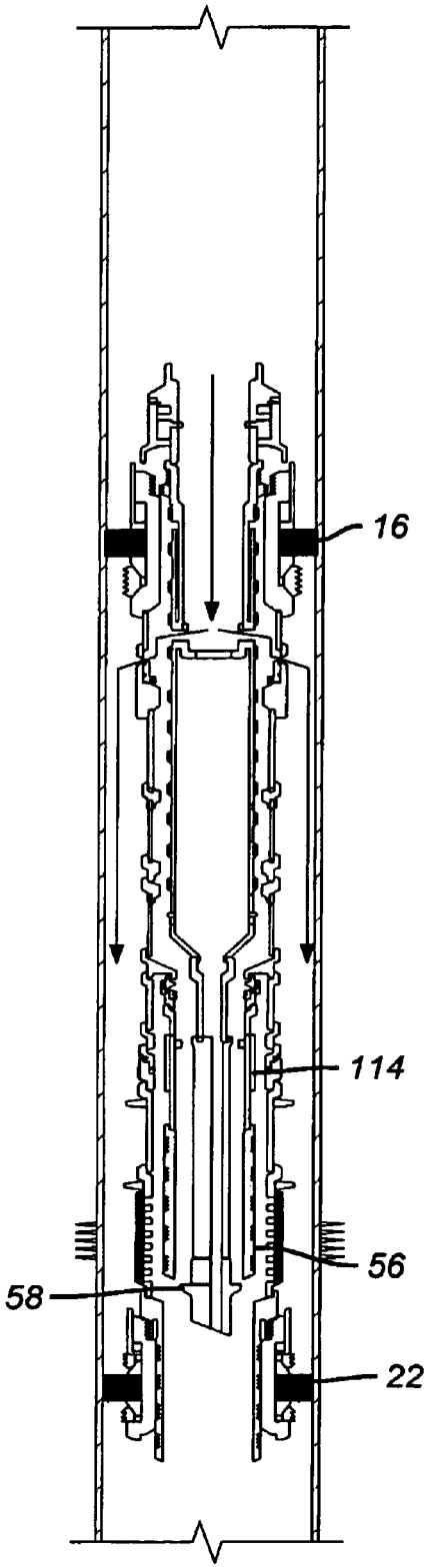
FIGS. 11–14 are an alternate to FIGS. 1–5 allowing returns by raising the concentric pipe instead of using a sliding sleeve valve adjacent the screen that is closed when the wash pipe is removed with the run-in string.
Figure 12:
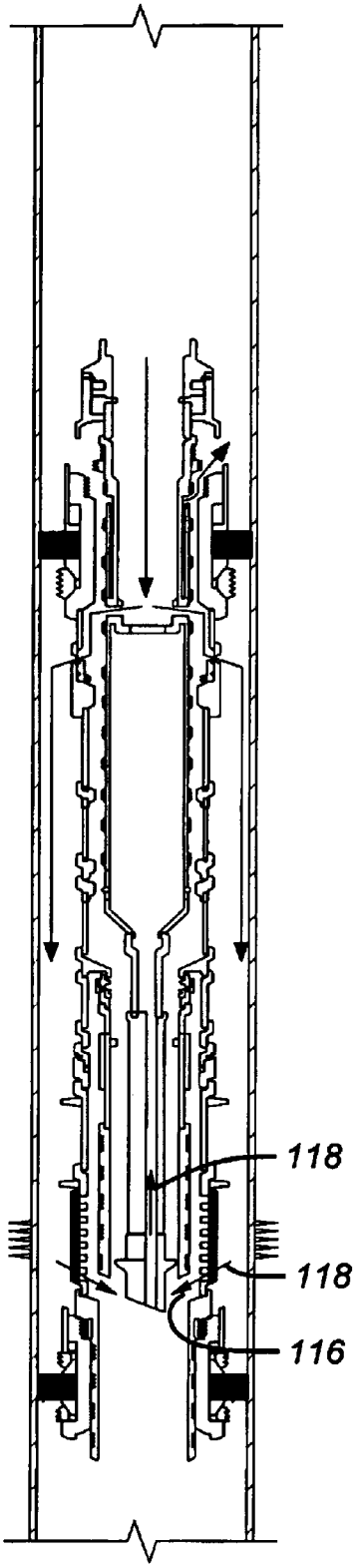
Figure 13:
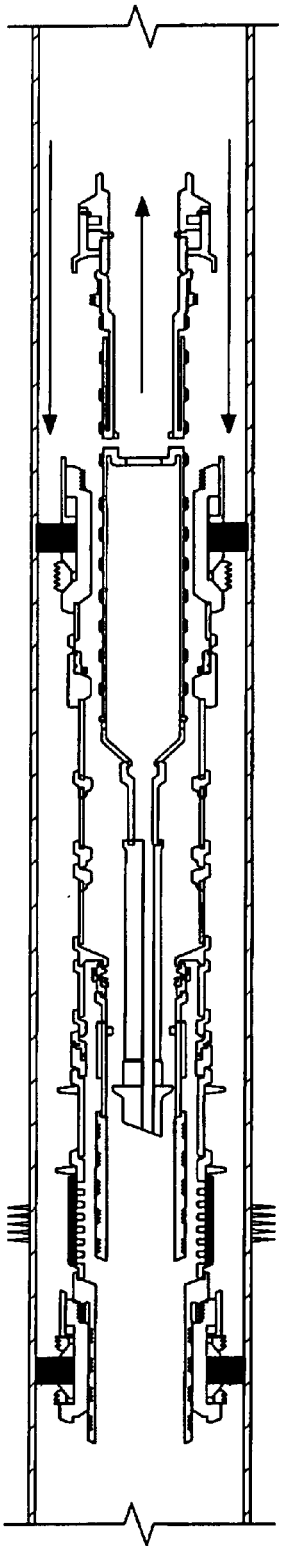
Figure 14:
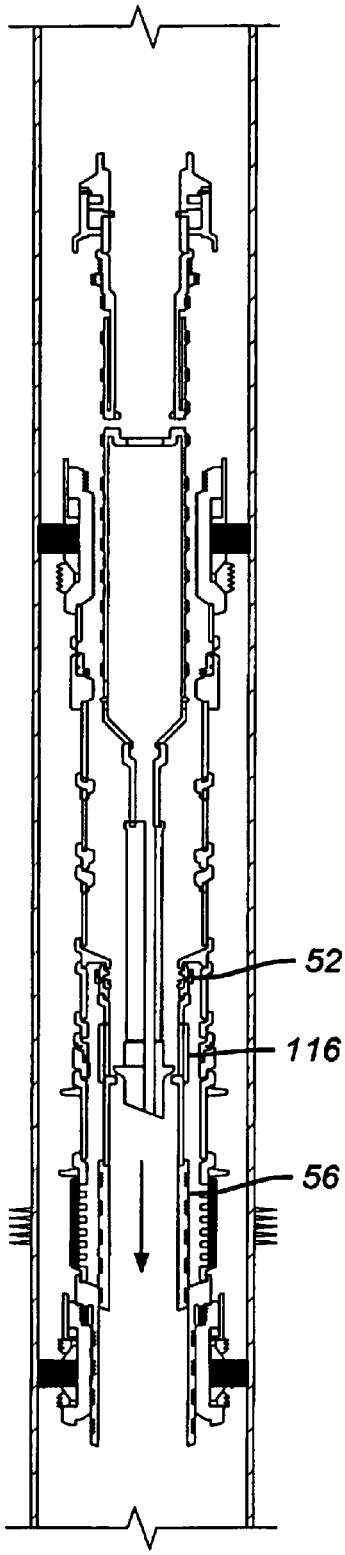

FIGS. 11–14 disclose essentially the same method as FIGS. 1–5 except that sliding sleeve valve 54 has been eliminated. The closure mechanism 58 on the wash pipe 20 now will have a different purpose. A telescoping joint 114 is in the retracted position for run in leaving a gap 116 between the seal assembly 56 and the sump packer 22. In FIG. 11, the crossover 18 is in position to allow a squeeze job into the perforations 24 with no return path available. In FIG. 12, the crossover 18 has been raised allowing return flow through gap 116 as shown by arrows 118. In this manner the gravel is deposited outside of screen 42. FIG. 13 shows the cross-over 18 raised to allow reversing out the gravel in the system, as previously described. FIG. 14 shows closure mechanism 58 engaging telescoping joint 116 to push it down. This motion also forces the seal assembly 56 down into sump packer 22 to sealingly close off gap 116. Thereafter, the valve assembly 52 is operated in the manner previously described. The advantage of this variation is to address the concerns of some operators that sliding sleeve valve 54 will not fully close when the wash pipe 20 and its closure mechanism 58 are moved out of the cased wellbore 10. Different solutions that provide for the requisite open and closed position of gap 116 than the preferred method described above are contemplated within the scope of the invention. The placement of the device that allows the relative movement can vary and the initial position can also be closed for run in so that gap 116 must be created with relative movement after run in.

When desired to isolate any given formation, a tool can engage the respective sliding sleeve 60 to close off on or more formations through their respective access ports 64.

Those skilled in the art will now appreciate that the apparatus and methods described above provide for several advantages over prior systems for gravel packing. The sliding sleeve valves 67 that are disposed in annular gap 44 and on the outside of tubular 66 are far fewer in number for a producing zone than the prior system provided by OSCA and previously described. In fact a single sliding sleeve valve 67 can be used for a single producing zone regardless of its thickness as measured by the screen footage for screen 42 to produce that zone. The construction of the screens used in the OSCA system dictates a sliding sleeve valve for each screen section because of the nature of the flow through the screen. On the other hand, the present invention has a large annular area 44 inside the screen 42 to allow a single set of openings 64 to service an entire producing zone. The present invention allows for backup access through sliding sleeve valve 54 or through perforation of blanking pipe 46 without damage to tubulars 40 due to the presence of annular area 44, as shown in FIG. 7. Alternatively, as shown in FIGS. 11–14 the gap 116 can be employed for production if the valve assembly 52 fails to open.

The other option is to use the removability feature shown in FIGS. 8–10 to replace the valve assembly 52 which failed to open. By providing redundancy through sliding sleeve valves 67 on the outside of tubular 66 and 60 on the inside combined with using as little as one such assembly for a producing zone, there is a greater assurance that a particular zone can be subsequently isolated and re-opened by manipulation of sliding sleeve valve 60. Additionally, the sliding sleeve valves 67 are in a protected location from circulating fluids in annular gap 44 so that they are more likely to reliably operate when needed.

The foregoing disclosure and description of the invention are illustrative and explanatory thereof, and various changes in the size, shape and materials, as well as in the details of the illustrated construction, may be made without departing from the spirit of the invention.

We claim:

1. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe and within said annular space to selectively take fluids passing from said isolated zone through said screen and into said annular space.

2. The method of claim 1, comprising:

using fluid pressure to operate said first valve.

3. The method of claim 2, comprising:

running in with said first valve in the closed position over said aperture in said inner pipe;

holding said first valve in the closed position against a bias force with a retainer;

breaking said retainer with pressure applied through said aperture to allow said bias force to open said first valve upon removal of applied pressure.

4. The method of claim 3, comprising:

providing a second valve on said inner pipe outside of said annular space to allow selective subsequent closure of said aperture;

locking said first valve in the open position once such position has been achieved.

5. The method of claim 1, comprising:

removing said inner pipe while leaving said screen in place.

6. The method of claim 1, comprising:

perforating said inner pipe without damaging said screen in the event said first valve fails to open.

7. The method of claim 1, comprising:

providing a second valve over a second aperture on said inner pipe;

operating said second valve open if said first valve fails to open.

8. The method of claim 1, comprising:

providing a portion of said inner pipe with a telescoping segment;

sliding said telescoping segment open if said first valve fails to open.

9. The method of claim 1, comprising:

using multiple sections of said screen in the given isolated zone;

providing a sufficient cross-sectional area in said annular space to allow a single first valve in said isolated zone to take production through said screen sections.

10. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe to selectively take fluids passing from said isolated zone through said screen and into said annular space;

removing said inner pipe while leaving said screen in place.

11. The method of claim 10, comprising:

perforating said inner pipe without damaging said screen in the event said first valve fails to open.

12. The method of claim 10, comprising:

providing a second valve over a second aperture on said inner pipe;

operating said second valve open if said first valve fails to open.

13. The method of claim 10, comprising:

providing a portion of said inner pipe with a telescoping segment;

sliding said telescoping segment open if said first valve fails to open.

14. The method of claim 10, comprising:

using multiple sections of said screen in the given isolated zone;

providing a sufficient cross-sectional area in said annular space to allow a single first valve in said isolated zone to take production through said screen sections.

15. The method of claim 10, comprising:

mounting said first valve within said annular space;

using fluid pressure to operate said first valve.

16. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe to selectively take fluids passing from said isolated zone through said screen and into said annular space;

perforating said inner pipe without damaging said screen in the event said first valve fails to open.

17. The method of claim 16, comprising:

providing a second valve over a second aperture on said inner pipe;

operating said second valve open if said first valve fails to open.

18. The method of claim 16, comprising:

providing a portion of said inner pipe with a telescoping segment;

sliding said telescoping segment open if said first valve fails to open.

19. The method of claim 16, comprising:

using multiple sections of said screen in the given isolated zone;

providing a sufficient cross-sectional area in said annular space to allow a single first valve in said isolated zone to take production through said screen sections.

20. The method of claim 16, comprising:

mounting said first valve within said annular space;

using fluid pressure to operate said first valve.

21. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe to selectively take fluids passing from said isolated zone through said screen and into said annular space;

providing a second valve over a second aperture on said inner pipe;

operating said second valve open if said first valve fails to open.

22. The method of claim 21, comprising:

using multiple sections of said screen in the given isolated zone;

providing a sufficient cross-sectional area in said annular space to allow a single first valve in said isolated zone to take production through said screen sections.

23. The method of claim 21, comprising:

mounting said first valve within said annular space;

using fluid pressure to operate said first valve.

24. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe to selectively take fluids passing from said isolated zone through said screen and into said annular space;

providing a portion of said inner pipe with a telescoping segment;

sliding said telescoping segment open if said first valve fails to open.

25. The method of claim 24, comprising:

using multiple sections of said screen in the given isolated zone;

providing a sufficient cross-sectional area in said annular space to allow a single first valve in said isolated zone to take production through said screen sections.

26. The method of claim 24, comprising:

mounting said first valve within said annular space;

using fluid pressure to operate said first valve.

27. A method of gravel packing a well comprising:

running in a gravel packing assembly comprising at least one section of screen in a given producing zone;

isolating the zone with packers;

delivering gravel into the wellbore outside said screen;

providing an inner pipe to create a sealed annular space internally of said screen;

providing a first valve over a first aperture on said inner pipe to selectively take fluids passing from said isolated zone through said screen and into said annular space;

using multiple sections of said screen in the given isolated zone;

providing a sufficient cross-sectional area in said annular space to allow a single first valve in said isolated zone to take production through said screen sections.

28. The method of claim 27, comprising:

mounting said first valve within said annular space;

using fluid pressure to operate said first valve.

* * * * *